US009067699B2

(12) United States Patent
Anatrini

(10) Patent No.: US 9,067,699 B2
(45) Date of Patent: Jun. 30, 2015

(54) APPARATUS AND A METHOD FOR REMOVING A STERILE PRODUCT FROM A STERILE PACKAGE CONTAINING THE PRODUCT

(75) Inventor: Dario Anatrini, Siena (IT)

(73) Assignee: CO.RI.M.A. S.R.L., Monteriggioni (Siena) (IT)

( * ) Notice: Subject to any disclaimer, the term of this patent is extended or adjusted under 35 U.S.C. 154(b) by 907 days.

(21) Appl. No.: 13/269,371

(22) Filed: Oct. 7, 2011

(65) Prior Publication Data

US 2012/0090280 A1 Apr. 19, 2012

(30) Foreign Application Priority Data

Oct. 14, 2010 (IT) ..... BO2010A0614

(51) Int. Cl.
*B65B 43/26* (2006.01)
*B65B 69/00* (2006.01)

(52) U.S. Cl.
CPC ..... *B65B 69/005* (2013.01); *B65B 69/0008* (2013.01); *B65B 69/0033* (2013.01)

(58) Field of Classification Search
CPC ..... B65B 69/00; B65B 69/0033
USPC ..... 53/492, 381.2; 414/412; 30/1.5, 2; 83/28, 54, 56, 151
See application file for complete search history.

(56) References Cited

U.S. PATENT DOCUMENTS 3,386,320 A * 6/1968 Pinkham et al. ..... 83/23
3,774,251 A * 11/1973 Pellman ..... 7/132
3,889,442 A * 6/1975 Grahn et al. ..... 53/492
4,158,417 A * 6/1979 Inoue ..... 414/412
4,207,021 A * 6/1980 Burdett, Jr. ..... 414/412
4,344,268 A * 8/1982 Wakamatsu et al. ..... 53/381.2
4,463,641 A * 8/1984 Sato ..... 83/175
4,690,676 A * 9/1987 Moulding et al. ..... 604/189
4,840,011 A * 6/1989 Muramatsu et al. ..... 53/381.2
4,986,000 A * 1/1991 Mills ..... 30/278
5,048,267 A * 9/1991 Kudo et al. ..... 53/492
5,059,082 A * 10/1991 Tanttu et al. ..... 414/412
5,175,979 A * 1/1993 van der Werff et al. ..... 53/492
5,275,524 A * 1/1994 Ishiwata ..... 414/412

(Continued)

FOREIGN PATENT DOCUMENTS

DE 102007027878 A 12/2008

OTHER PUBLICATIONS

European Search Report for EP 2441692, Dated Feb. 1, 2012, 3 pages.

*Primary Examiner* — Gloria R Weeks
(74) *Attorney, Agent, or Firm* — Ware, Fressola, Maguire & Barber LLP

(57) ABSTRACT

The invention relates to a method for removing a sterile product from a sterile package which contains the sterile product and to an apparatus (1) for actuating the method. The method comprises clamping a part of a sterile package (5) located between the sterile product (6) and a first flap (7), and cutting the sterile package (5) at a region (9) interposed between the clamped surfaces (3, 4) and the flap (7). Once the facing surfaces (3, 4) are disengaged, an opening (10) is identified in the sterile package (5), through which the sterile product (6) can be expelled. The surfaces (3, 4) are then disengaged from the clamping action, and the sterile product (6) expelled from the sterile package (5) through the opening (10) by exerting a pushing action on an external surface of the sterile package (5).

9 Claims, 11 Drawing Sheets

(56) References Cited

U.S. PATENT DOCUMENTS

| | | | | |
|---|---|---|---|---|
| 5,285,575 | A * | 2/1994 | Hirano | 30/2 |
| 5,347,671 | A * | 9/1994 | Hunts | 7/156 |
| 5,375,961 | A * | 12/1994 | Mojden et al. | 414/412 |
| 5,419,095 | A * | 5/1995 | Yohe | 53/384.1 |
| 5,423,649 | A * | 6/1995 | Maeda et al. | 414/412 |
| 5,649,411 | A * | 7/1997 | Dirx | 53/492 |
| 6,189,298 | B1 * | 2/2001 | Kuji et al. | 53/492 |
| 6,244,019 | B1 * | 6/2001 | Ljungqvist et al. | 53/386.1 |
| 6,431,813 | B2 * | 8/2002 | Sugaya et al. | 414/412 |
| 6,578,243 | B1 * | 6/2003 | Hall | 24/501 |
| 6,705,818 | B2 * | 3/2004 | Sagaya et al. | 414/411 |
| 6,725,631 | B2 * | 4/2004 | Skrak et al. | 53/492 |
| 6,775,960 | B2 * | 8/2004 | Hansen | 53/492 |
| 7,048,489 | B2 * | 5/2006 | Sugaya et al. | 414/412 |
| 7,174,695 | B2 * | 2/2007 | Porter et al. | 53/381.2 |
| 7,540,222 | B2 * | 6/2009 | Kim | 83/84 |
| 7,726,104 | B2 * | 6/2010 | Buchko et al. | 53/512 |
| 7,752,758 | B2 * | 7/2010 | Gelardi | 30/124 |
| 7,827,770 | B2 * | 11/2010 | Rocholl et al. | 53/469 |
| 7,992,477 | B2 * | 8/2011 | Yuyama et al. | 83/385 |
| 8,769,801 | B2 * | 7/2014 | Lyman | 29/564.3 |
| 2013/0000261 | A1 * | 1/2013 | Lyman | 53/492 |

* cited by examiner

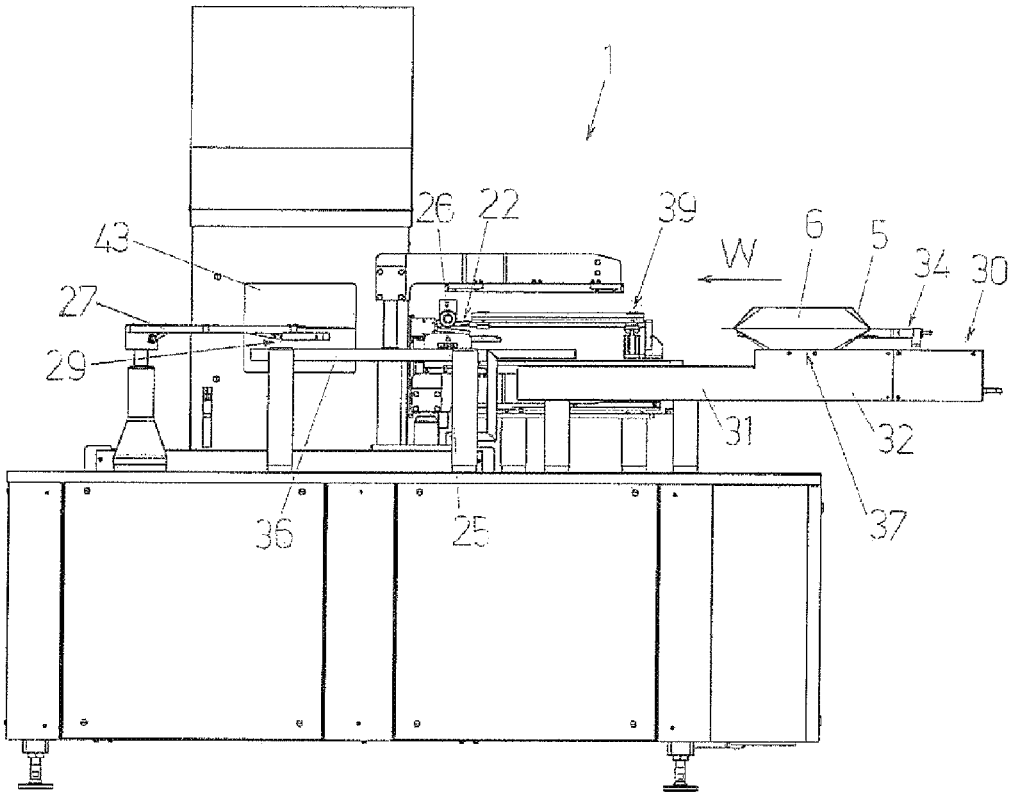
FIG 1C
FIG 1D
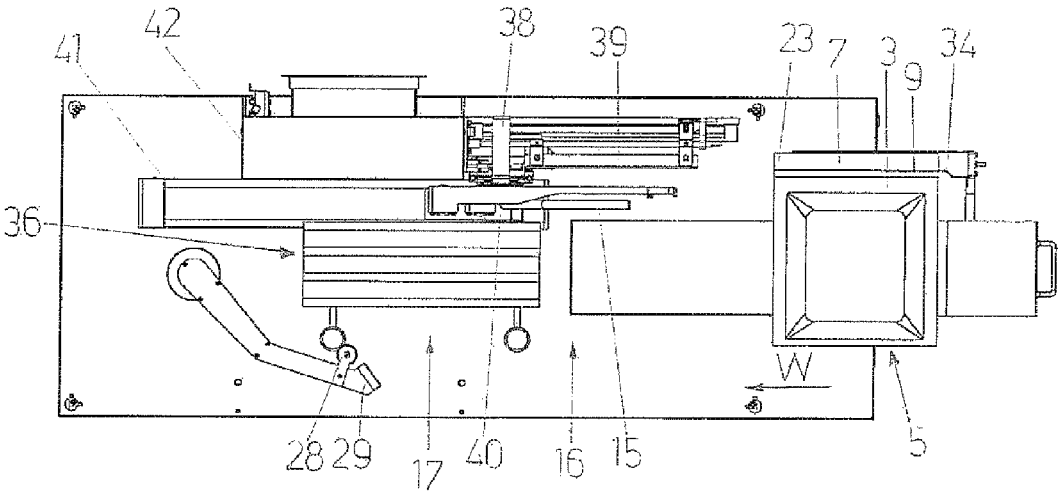

APPARATUS AND A METHOD FOR REMOVING A STERILE PRODUCT FROM A STERILE PACKAGE CONTAINING THE PRODUCT

FIELD OF THE INVENTION

The present invention relates to the technical sector of machines for packing products.

In particular, the invention relates to a method for removing a sterile product from a sterile package, as well as an apparatus for actuating the method.

DESCRIPTION OF THE PRIOR ART

Apparatus operating in sterile environments, for example destined for manipulating medicinal products, include special particularities such as not to contaminate the products themselves.

A production line can comprise a plurality of sterile environments separated from one another; it follows that the sterile products manipulated in a first sterile environment have to be transferred to a second sterile environment in order to undergo subsequent operations. During the transfer it is necessary to take the right precautions to prevent the sterile products from becoming contaminated.

By way of example, a sterile product is identified in a tray containing syringes or parts of syringes. The tray containing the syringes is manipulated and/or treated in the first sterile environment and has to be transferred to the second sterile environment in order to undergo further manipulation operations. Each tray containing the syringes is enveloped, in the first sterile environment, by a protective film which forms a first closed pack; the tray, the syringes contained therein and the containing pack are sterile.

The pack containing the tray and the syringes is sent towards the second sterile environment; at the inlet section of the second sterile environment the package is removed and subsequently the tray containing the syringes is transferred internally of the second sterile environment, for the subsequent manipulation operations thereon.

In order to remove a sterile product from a sterile package, a known-type apparatus is arranged at the inlet section of the second sterile environment which operates on the sterile packages containing sterile products, which packages are transferred by a conveyor towards the inlet section of the second sterile environment, according to a movement direction. The apparatus comprises: means for gripping an edge of the sterile package, arranged and acting transversally with respect to the movement direction; means for retaining the sterile package, arranged above the sterile package stationary in the inlet section of the second sterile environment and acting vertically in order to retain, by means of suckers, the upper portion of the sterile package; a cutting blade arranged on the same side in which the clamping means are arranged and movable parallel with respect to the movement direction in order to cut the sterile package at the upper portion thereof, thus creating an opening; pick-up means arranged on the same side in which the clamping means are arranged and acting in a transversal direction with respect to the movement direction in order to extract the sterile product from the sterile package through the opening made therein, using relative suckers.

The apparatus acts according to the following steps: the sterile package containing the sterile product arrives in the inlet section of the second sterile environment; the clamping means act to clamp the edge of the sterile package facing them and the retaining means act to retain the upper portion of the sterile package, such as to create a surface tension on the upper free portion of the sterile interposed between the gripped edge and the area retaining by the suckers; the blade is moved along the movement direction such as to cut away the upper free portion of the sterile package; the clamping means, still gripping the flap of the sterile package thus cut, are moved lower; the pick-up means are moved in a transversal direction to the movement direction first in order to intercept, with the suckers, the surface of the sterile product facing them (for example a tray containing syringes) and then to pick up the sterile product and transfer it into the second sterile environment.

The blade lacerates the upper free portion of the sterile package, penetrating into the internal volume identified by the package: the opening thus created, necessary for enabling the following pick-up operations of the sterile product, can enable volatile particles and/or residual particles of the sterile package to diffuse in the internal volume and contaminate it. As a consequence, the sterile product contained in the package can be contaminated.

The blade and the suckers of the pick-up means can represent sources of contamination for the sterile product if they are not regularly and carefully sterilized.

SUMMARY OF THE INVENTION

The aim of the present invention therefore consists in obviating the above-cited drawbacks.

The above aims are obtained with a method according to the present invention and using an apparatus according to the present invention.

In accordance with the present invention, a method is defined for removing a sterile product from a sterile package containing the sterile product, comprising the following steps:

- clamping against one another a first and a second facing surfaces which are a part of a sterile package, locatable between the sterile product contained in the sterile package and a relative first flap of the sterile package;
- cutting the sterile package at a region thereof which is interposed between the reciprocally-clamped facing first surface and second surface of the sterile package and the flap of the sterile package such that once the facing first surface and second surface of the sterile package are disengaged by the clamping action, an opening is identified in the sterile package, through which the sterile product can be expelled;
- disengaging the facing first surface and second surface of the sterile package from the clamping action;
- expelling the sterile product from the sterile package by exerting a pushing action on an external surface of the sterile package such as to move the sterile product through the opening.

The removal of the sterile product from the sterile package is advantageously done without any possible contamination of any kind. During the step of cutting the tubular package remains sealed thanks to the clamping action acting on the opposite first surface and second surface. The internal volume of the sterile package, therefore, remains inaccessible from outside during the cutting step. Further, the step of expelling the sterile product includes a pushing action on the external surface of the tubular package. The sterile product is pushed out of the sterile package by a pushing action acting indirectly on the sterile package thanks to the interposing of the sterile package. In other words, the sterile internal walls of the sterile package directly contact the sterile product and cause it to exit from the sterile package by effect of the above-mentioned pushing action.

Like advantages are attained by the apparatus according to the present invention. The apparatus for removing a sterile product from a sterile package, which apparatus performs the method of the invention, comprises:

clamping means for clamping against one another a facing first surface and a second surface which are part of a sterile package, the facing first surface and second surface being locatable between a sterile product contained in the sterile package and a relative flap of the sterile package;

cutting means for cutting the sterile package at a relative region thereof interposed between the facing first surface and second surface, clamped to one another, of the sterile package and the flap of the sterile package, such that once the facing first surface and second surface of the sterile package are disengaged by the clamping action of the gripping means, an opening is identified in the sterile package through which the sterile product can be expelled;

expulsion means for expelling the sterile product from the sterile package by exerting a pushing action on the external surface of the sterile package such as to move the sterile product through the opening.

BRIEF DESCRIPTION OF THE DRAWINGS

Specific embodiments of the invention, and advantageous technical-functional characteristics correlated to these embodiments only in part derivable from the above description will be described in the following description, in accordance with what is set out in the claims and with the aid of the accompanying drawings, in which:

FIGS. 1C, 1D are respectively a front view and a view from above of the apparatus (1) of FIG. 1A;

DESCRIPTION OF PREFERRED EMBODIMENTS

Figures 1A, 1B:
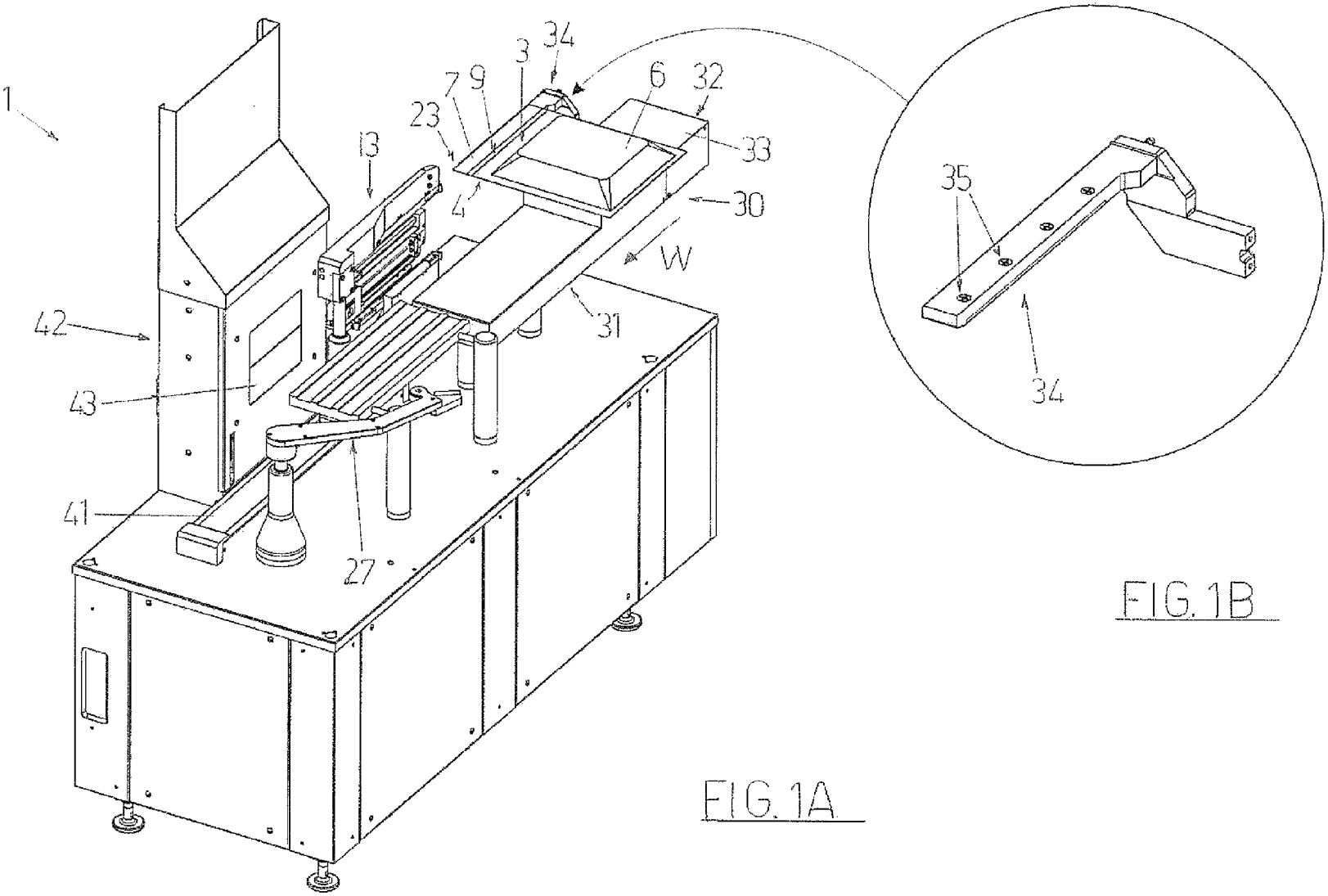
FIG. 1A is a perspective view of the apparatus of the present invention in a first operating configuration.
FIG. 1B is an enlarged view of a detail of FIG. 1A.

With general reference to the accompanying tables of the drawing, the apparatus 1 of the present invention, represented in different scales in the different above-mentioned operating configurations, comprises:

clamping means 13, 14, 15 for clamping against one another a facing first surface 3 and a second surface 4 which are part of a sterile package 5, the facing first surface 3 and second surface 4 being locatable between a sterile product 6 contained in the sterile package 5 and a relative flap 7 of the sterile package 5;

cutting means 25, 26 for cutting the sterile package 5 at a relative region 9 thereof interposed between the facing first surface 3 and second surface 4, clamped to one another, of the sterile package 5 and the flap 7 of the sterile package 5, such that once the facing first surface 3 and second surface 4 of the sterile package 5 are disengaged by the clamping action of the gripping means 13, 14, 15, an opening 10 is identified in the sterile package 5 through which the sterile product 6 can be expelled;

expulsion means 27, 28 for expelling the sterile product 6 from the sterile package 5 by exerting a pushing action on the external surface of the sterile package 5 such as to move the sterile product 6 through the opening 10.

The apparatus 1 can comprise retaining means 55, 29 provided for retaining the sterile package 5 during expulsion of the sterile product 6 through the opening 10.

The clamping means 13, 14 comprise a first pliers 13 comprising in turn two jaws 14, 15, reciprocally movable in nearing and distancing respectively in order to clamp and disengage the facing first surface and second surface 4 of the sterile package 5.

The apparatus 1 can comprise a first work station 16 in which the cutting means 25, 26 act and in which the cutting of the sterile package 5 is performed, and a second work station 17 adjacent to the first work station 16, in which the expulsion means 27, 28 operate and in which the sterile product 6 is expelled through the opening 10 of the sterile package 5, the jaws 14, 15 being movable between the first work station 16 and the second work station 17.

The retaining means comprise first aspirating means 55 acting along the facing contact surfaces 19 of the jaws 14, 15 in order to enable distancing of opposite portions 20, 21 of sterile package 5 containing respectively the facing first surface 3 and second surface 4 of the sterile package 5. The first aspirating means 55 comprise, for example, an aspirating source (not indicated) and aspirating openings 55 predisposed along the contact surface 19 facing the jaws 14, 15.

The apparatus 1 can comprise a second pliers 22, for example fixed, arranged in the first work station 16 for gripping the end 23 of the flap 7 closer to the second work station 17, the dimensions of the sterile package 5 and the position of the second work station 17 with respect to the first work station 16 being such that the flap 7, once partially detached by effect of the cutting of the sterile package 5, can be retained by the second pliers 22 when the sterile package 5 is transferred into the second work station 17 and during expulsion of the sterile product 6, remaining connected to the remaining part of the sterile package 5 and without obstructing the stage of expulsion of the sterile product 6.

The apparatus can comprise removable blocking means 39 of the flap 7 for facilitating cutting of the sterile package 5 in cooperation with the jaws 14, 15.

The cutting means 25, 26 comprise: a counter-blade 25; a first rotating cutting roller 26 provided with a cutting edge, which first cutting roller 26 faces the counter-blade 25; means for pressing the first rotating cutting roller 26 against the counter-blade 25 during the cutting of the sterile package 5. In particular, the counter-blade 25 is an idle second roller 25; the first cutting roller 26 is also an idle roller.

This cutting modality is particularly advantageous: the first cutting roller 26 is pressed by the pressing means against the counter-blade 25; the region 9 of the sterile package 5 interposed between the first cutting roller 26 and the second roller 25 or counter-blade 25 is cut along a cutting profile and sealed, by effect of the compression exerted by the first cutting roller 26, against the second roller 25, in the environs of the cutting profile. The sealing tends to remain during the cutting and immediately after, thus guaranteeing insulation of the internal volume of the sterile package 5 from the outside, while the jaws 14, 15 distance, by means of the first aspirating means 55, the opposite portions of sterile package 5 which have been cut, enabling identification of the opening 10 of the sterile package 5 and thus placing the internal volume of the sterile package 5 in communication with the outside.

The expelling means 27, 28 comprise a rotating arm 27, rotating with respect to a vertical axis, provided with a terminal part 28 for abutting against the sterile package 5 and second aspirating means 29 which can be activated to retain the sterile package 5 once the sterile product 6 has been expelled through the opening 10; the rotating arm 27 being arranged such as to exert a pushing action on a portion of the sterile package 5 which is arranged on an opposite side of the opening 10 with respect to a position of the sterile product 6 contained in the sterile package 5. The terminal part 28 is for example an idle roller.

By way of example, the sterile product 6 comprises a tray containing syringes or parts thereof.

The apparatus 1 comprises a loading member 30 mobile along guides (not illustrated) in a movement direction W (FIG. 1A); the loading member 30 develops longitudinally and is orientated along the movement direction W: it comprises two parallelepipeds in a single body, i.e. a front parallelepiped 31, i.e. arranged frontally with respect to the movement direction W, and a rear parallelepiped 32 having a greater height with respect to the first front parallelepiped 31. The rear parallelepiped 32 is provided with a raised upper surface 33 for supporting the sterile package 5.

The loading member 30 further comprises a support arm 34 fixed to the rear parallelepiped 32, from which it laterally projects such as to restingly receive the flap 7 of the sterile package 5 (FIGS. 1A, 1B). The distance of the support arm 34 with respect to the loading member 30 can be regulated according to the format and the characteristics of the sterile package 5 (for example the width of the flap 7) which contains the sterile product 6.

The support arm 34 comprises aspirating openings 35 arranged along the relative upper surface which restingly receives the flap 7 of the sterile package 5, the aspirating openings 35 being activatable with the aim of guaranteeing the stable positioning of the flap 7 on the support arm 34 and thus also the sterile package 5 on the loading member 30.

The loading member 30 is mobile between a retracted end position, of loading the sterile package 5 (FIGS. 1A, 1C, 1D), in which the sterile package 5 can be arranged on the loading member 30 for example by an operator, and an advanced end position (see for example FIGS. 2A, 2D, 2E) such as to bring the sterile package 5 supported thereby into the first operating station 16.

The apparatus 1 comprises a horizontal rest plane 36 which is arranged in the second operating station 17, which rest plane 36 exhibits an upper rest surface 37 substantially aligned with the upper raised surface 33 of the loading member 30 in order to facilitate transfer of the sterile package 5 from the raised upper surface 33 to the upper rest surface 37; the arrangement and conformation of the rest plane 36 and the front parallelepiped 31 are such that the front parallelepiped 31, when the loading member 30 reaches the advanced end position, is arranged below the rest plane 36. However, the loading member 30 can be without the front parallelepiped 31.

Figure 2B:
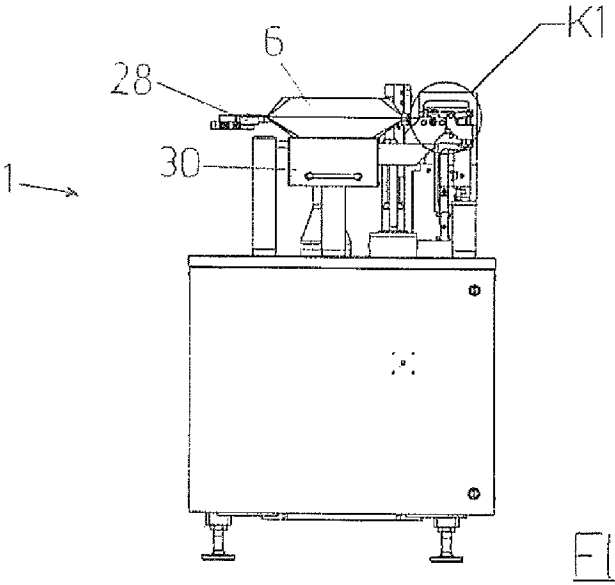
FIG. 2B is a lateral view of the apparatus of FIG. 2A.
Figure 2C:
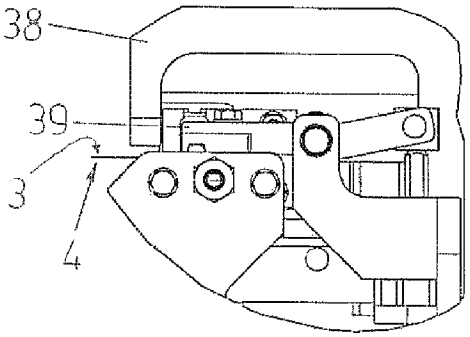
FIG. 2C is an enlarged view of detail K1 of FIG. 2B.
Figure 2A:
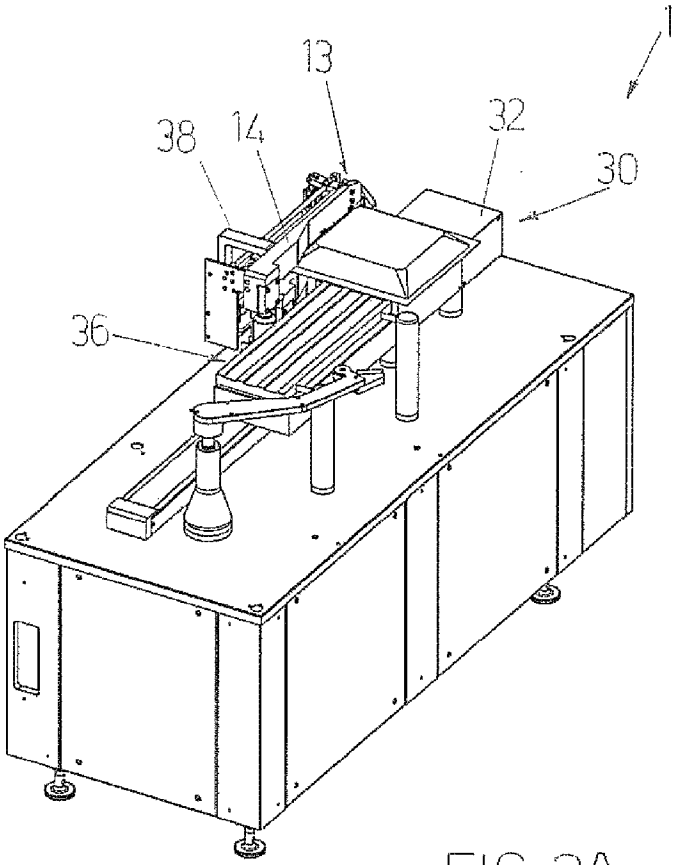
FIG. 2A is a perspective view of the apparatus of the present invention, in a second operating configuration.
Figure 2D:
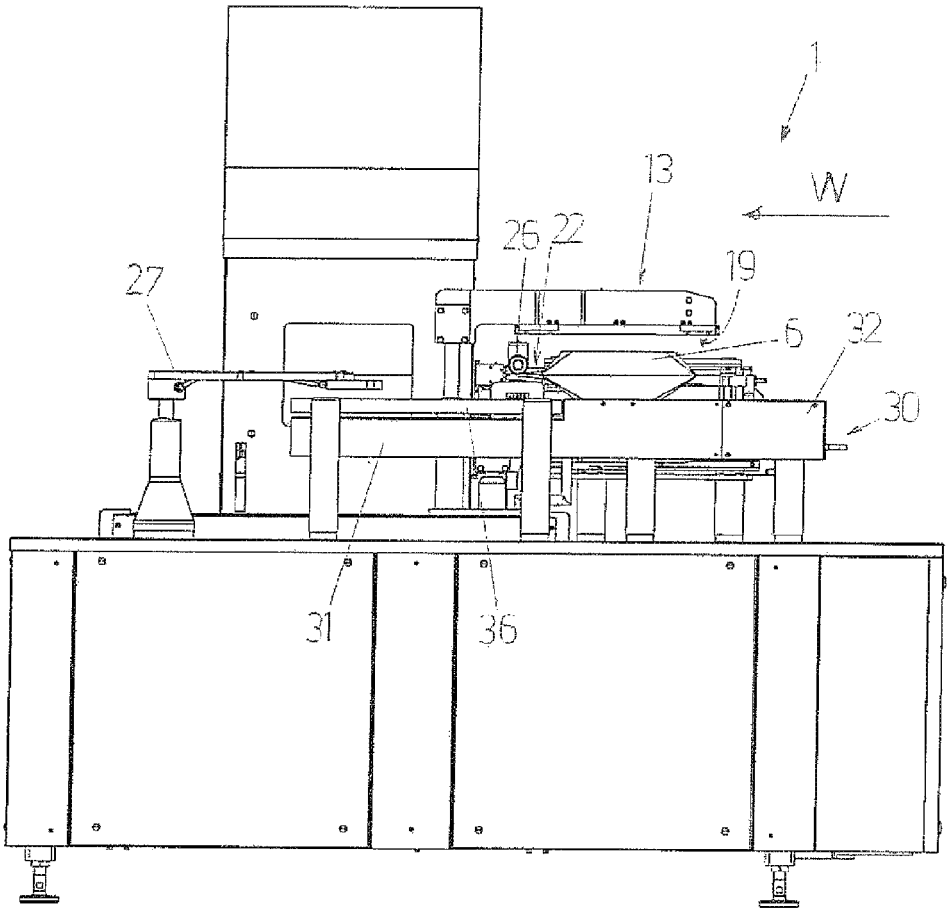
FIGS. 2D, 2E are respectively a frontal view and a view from above of the apparatus (1) of FIG. 2A.
Figure 2E:
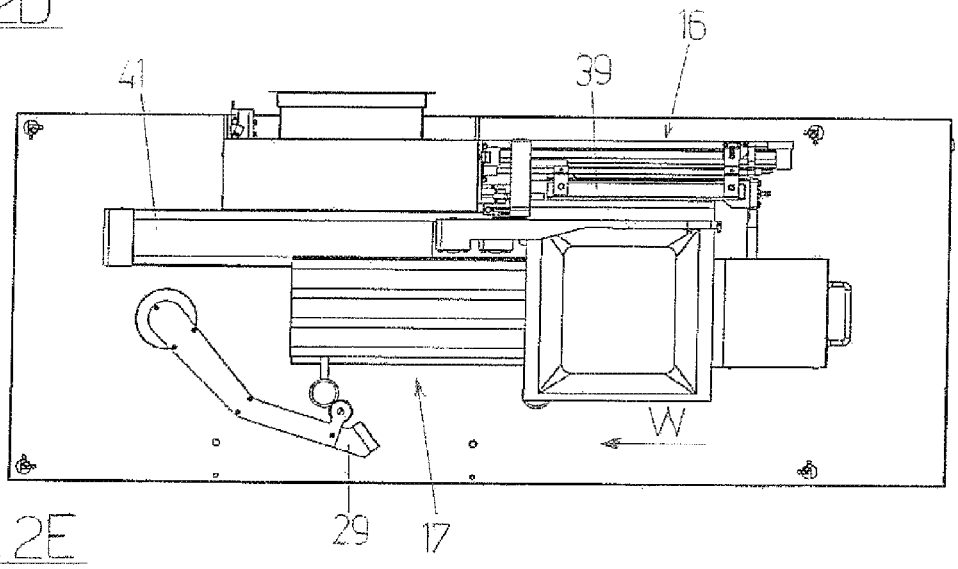
Figure 3B:
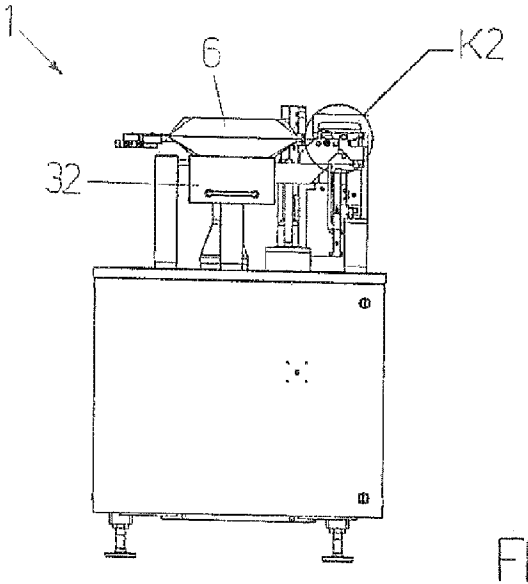
FIG. 3B is a lateral view of the apparatus of FIG. 3A.

The removable blocking means 39 comprise an abutting lever 39 having a longitudinal development, which is arranged in the first operating station 16, by a side of the loading member 30, and is orientated parallel to the movement direction W. The lever 39 is activated between an engaged position (FIGS. 3X, 4B) and a disengaged position (FIGS. 2C, 5B). The position of the lever 39 with respect to the support arm 34 of the loading member 30 is such that in the relative engaged position it superiorly abuts the flap 7 of the sterile package 5, in turn supported by support arm 34 and retained in the aspirating position which is realized through the aspirating openings 35 of the support arm 34 connected to an aspirating source (not indicated); in the disengaged position the lever 39 is raised and therefore disengages the flap 7 of the sterile package 5. The longitudinal extension of the lever 39 is lower than that of the flap 7 of the sterile package 5; the lever 39 is arranged, with respect to the support arm 34 (in the relative advanced end position) such that in the engaged position it partially covers the flap 7, leaving the end 23 of the flap 7 that is closer to the second operating station 17 free (see FIG. 4B in particular); the free end of the flap 7 that is closer to the second operating station 17 is subjected to the action of the second pliers 22.

The second pliers 22 is, as mentioned, for example fixed and acts between a gripping configuration, in which it retains the end 23 of the flap 7 when the sterile package 5 reaches the first operating station 16, and a release configuration in which it releases the end 23 of the flap 7 once the sterile product 6 has been expelled from the sterile package 5. The second pliers 22 and the lever 39 are arranged such as not to tangle with one another when the second pliers 22 are in the gripping configuration of the end 23 of the flap 7 closer to the second operating station 17 and the lever 39 is in the engaged position, see FIG. 4B.

The jaws 14, 15 have a longitudinal development and are orientated parallel to the movement direction W; they are arranged one above the other and act on the sterile package 5 in a vertical direction between clamping configuration of the first surface 3 and the second surface 4 facing the sterile package 5 and a distanced configuration, of disengagement of the opposite first surface 3 and second surface 4; further, they are both borne by a carriage 40 which slides along a horizontal guide 41 which extends along the first operating station 16 and the second operating station 17 parallel to the movement direction W, in order to enable the jaws 14, 15 to displace between the first operating station 16 and the second operating station 17.

The cutting means 25, 26 are arranged in the first operating station 16, laterally with respect to the loading member 30, and as mentioned comprise the first cutting roller 26 and the counter-blade 25 having the shape of a second roller 25 which is arranged inferiorly to the first cutting roller 26 and is opposite it; the first cutting roller 26 and the second roller 25 are connected to a same carriage 40 (not illustrated) and are mobile along a parallel direction to the movement direction W in order to perform the cutting of the sterile package 5, between a first end cutting position which is advanced with respect to the movement direction W (see for example FIGS. 1C, 1D, 2D, 2E and a second end cutting position which is retracted with respect to the movement direction W (see for example FIGS. 4A, 4B, 5A, 5B, 5C, 5D). A structural element 38 which is a part of the cutting means 25, 26 has an L-shape, bears the first cutting roller 26 and is in turn borne by the carriage 40 (FIG. 5B); the structural element 38 is subjected to pneumatic means, not indicated, for pressing the first cutting roller 26 against the second roller 25 during the cutting of the sterile package 5.

The position of the loading member 30 and the relative support arm 34 on the one hand, and of the first cutting roller 26 and the second roller 25 on the other hand, is such that the cutting happens, as mentioned, in the region 9 interposed between the first surface 3 and the second surface 4, facing and clamped to one another of the sterile package 5 and the flap 7 of the sterile package 5. During the cutting of the sterile package 5, the jaws 14, 15 clamp the sterile package 5 while the lever 39 is in the relative engaged position such as to abut the flap 7 of the sterile package 5; in this way, the region interposed between the first surface 3 and the second surface 4, opposite and clamped to one another, of the sterile package 5 and the flap of the sterile package 5 is in tension, which optimizes the cutting of the sterile package 5.

The cutting is done starting from the end 23 of the flap 7 that is closer to the second operating station 17 up to near the opposite end, i.e. the end which is further from the second operating station 17 when the sterile package 5 is in the first operating station 16. In this way the sterile flap 7 remains attached to the remaining part of the sterile package 5 and can thereafter be removed more easily from the apparatus 1 in order to be conveyed, for example, to a collecting tub, not illustrated.

The apparatus 1 is arranged such that the second operating station 17 is arranged at the inlet section 42 of a sterile environment and such that the expulsion of the sterile product 6 is done via the relative inlet mouth 43 of the inlet section 42 of the sterile environment.

The functioning of the apparatus 1 as described above will now be illustrated.

The sterile package 5 containing the sterile product 6 is loaded on the loading member 30 (FIGS. 1A, 1C, 1D); the flap 7 is retained in position on the support arm 34 by means of the activating of the aspirating openings 35 of the support arm 34.

Then the loading member 30 is moved, which brings the sterile package 5 towards the first operating station 16 (FIGS. 2A, 2C, 2D, 2E); the first cutting roller 26 and the second roller 25 are in the first extreme cutting position, such as not to interfere with the arrival of the sterile package 5, the lever 39 is in the disengaged position (FIG. 2C), the second pliers 22 are in the release configuration and the jaws 14, 15 are in the distanced configuration.

Figure 3C:
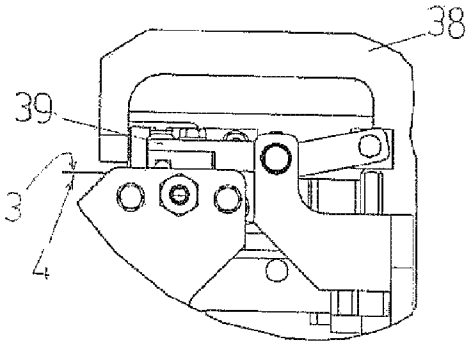
FIG. 3C is an enlarged view of detail K2 of FIG. 3B.
Figure 3A:
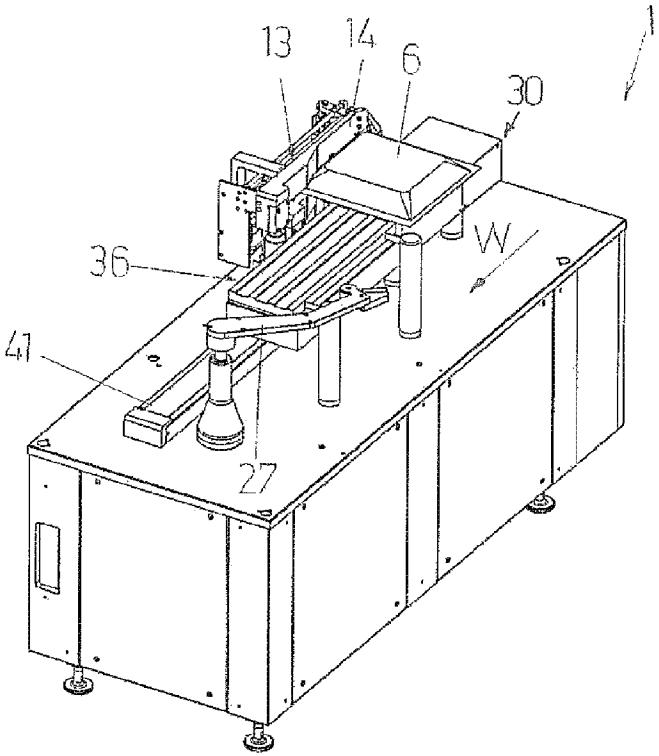
FIG. 3A is a perspective view of the apparatus of the present invention in a third operating configuration, in which some details have been removed.
Figure 3D:
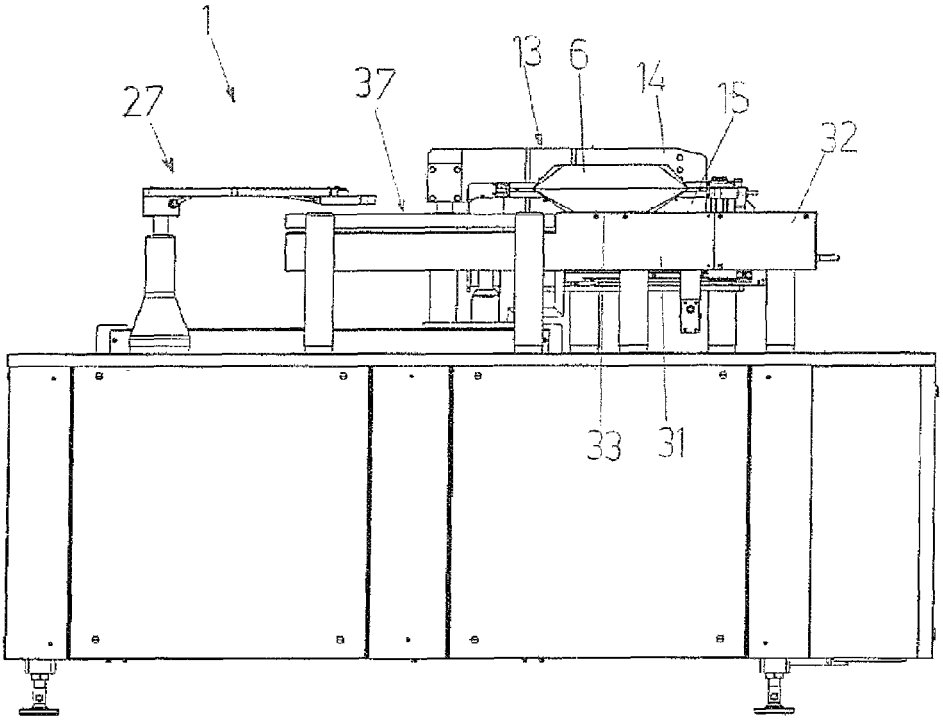
FIGS. 3D, 3E are respectively a front view and a view from above of the apparatus (1) of FIG. 3A.
Figure 3E:
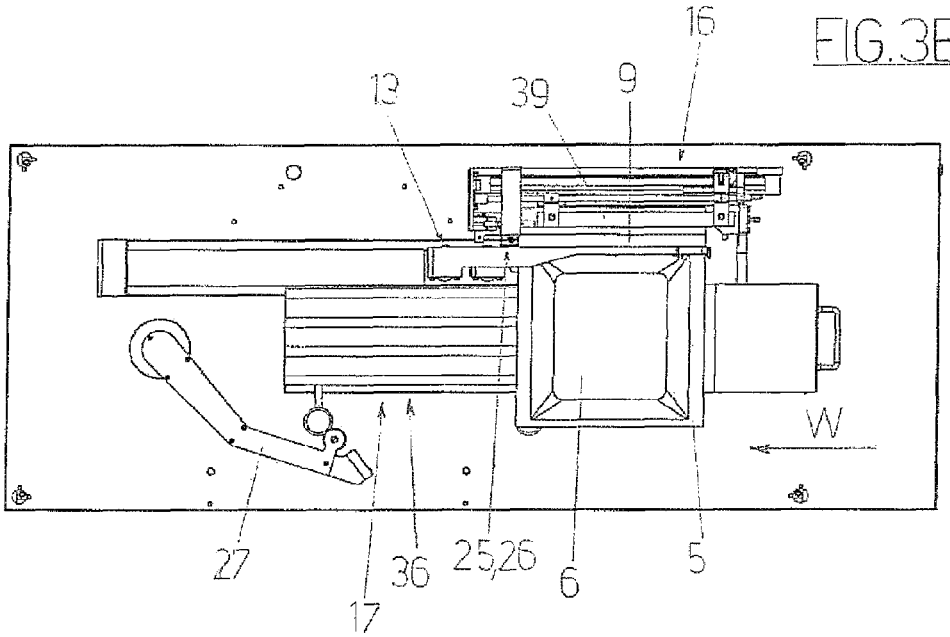

When the sterile package 5 has reached the first operating station 16 (FIGS. 3A-3E), the jaws 14, 15 reach the clamped configuration, the lever 39 reaches the engaged position (FIG. 3C), the aspirating openings 35 of the support arm 34 are deactivated and the second pliers 22 reach the gripping configuration.

Figure 4B:
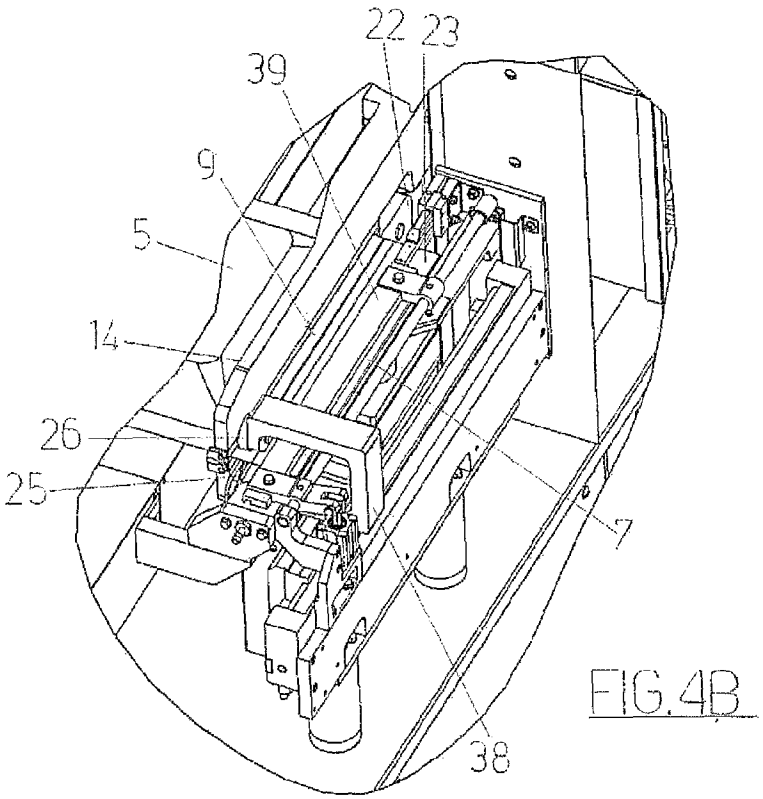
FIG. 4B is a perspective view of detail K3 of FIG. 4A according to arrow J1 of FIG. 4A.
Figure 4A:
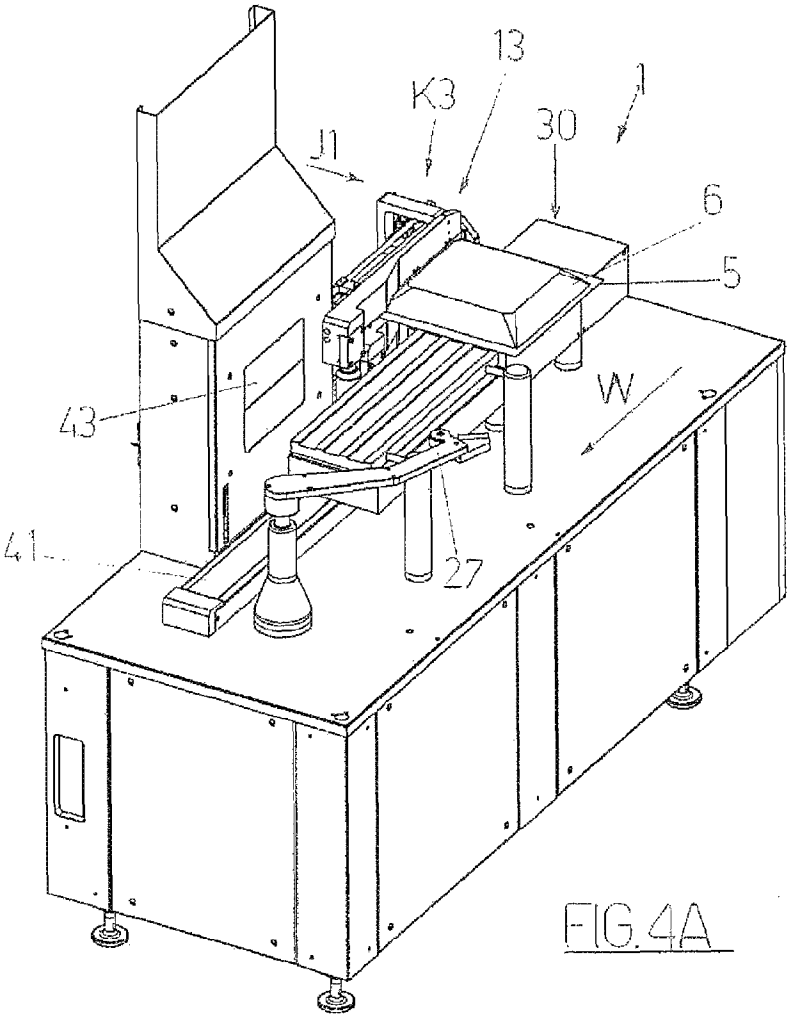
FIG. 4A is a perspective view of the apparatus of the present invention, in a fourth operating configuration.
Figure 5B:
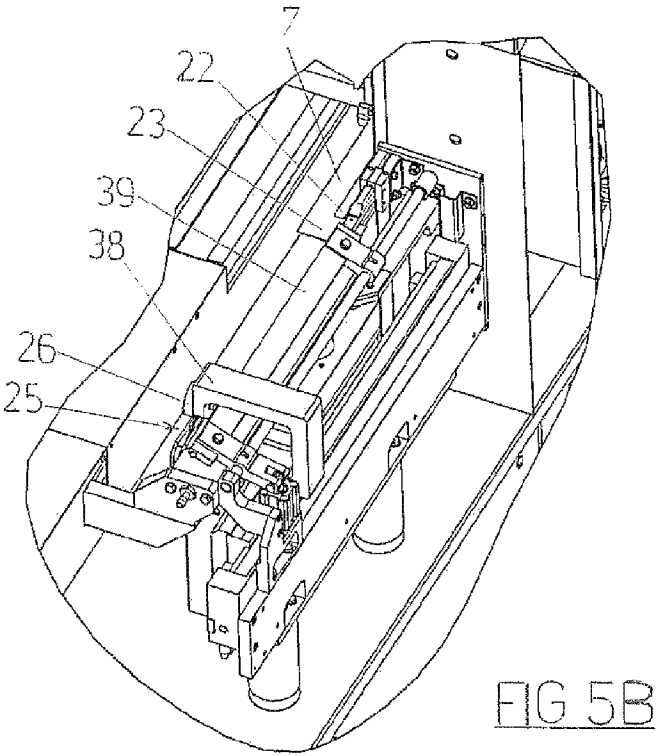
FIG. 5B is a perspective view of the detail K4 of FIG. 5A according to arrow J2 of FIG. 5A.

The flap 7 of the sterile package 5 is now partially cut; the cut is performed by moving the carriage 40 which bears the first cutting roller 26 and the second roller 25 from the end advanced position to the end retracted position (FIGS. 4A, 4B). As is clear from the above description, the extreme retracted position reached by the first cutting roller 26 and the second roller 25 corresponds to the partial cutting of the sterile package 5 along the region 9: the end of the flap 7 further from the second operating station 17 is attached to the remaining part of the sterile package 5 (as can be seen by observing FIG. 4B).

Figure 5A:
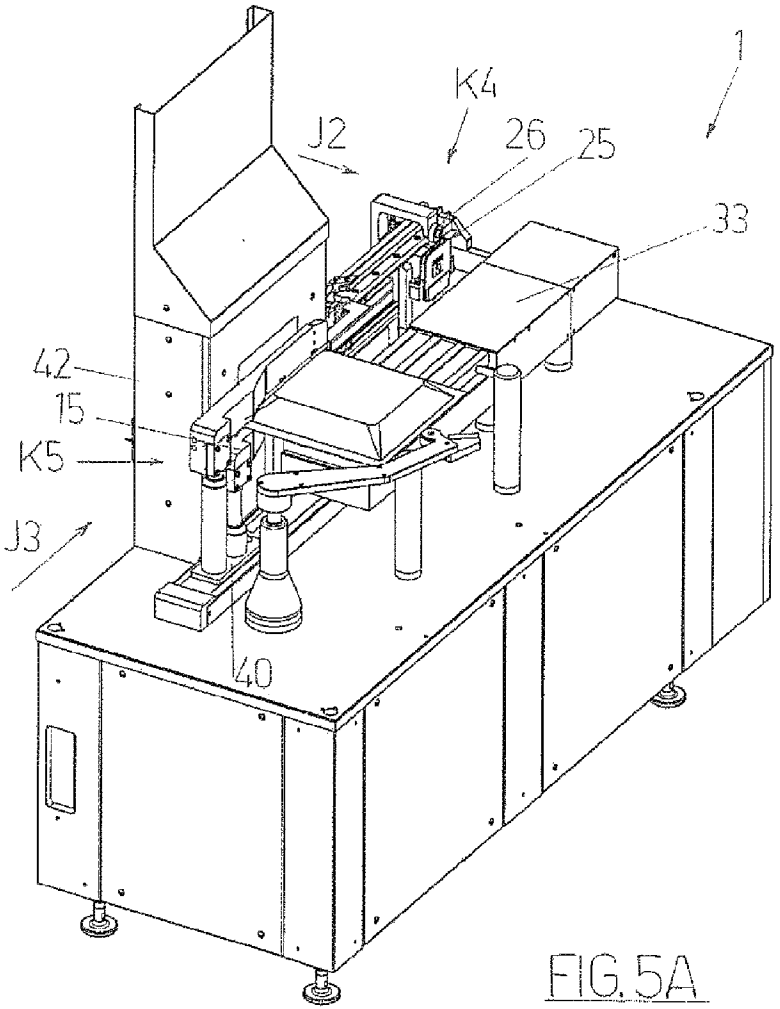
FIG. 5A is a perspective view of the apparatus of the present invention, in a fifth operating configuration.
Figure 5C:
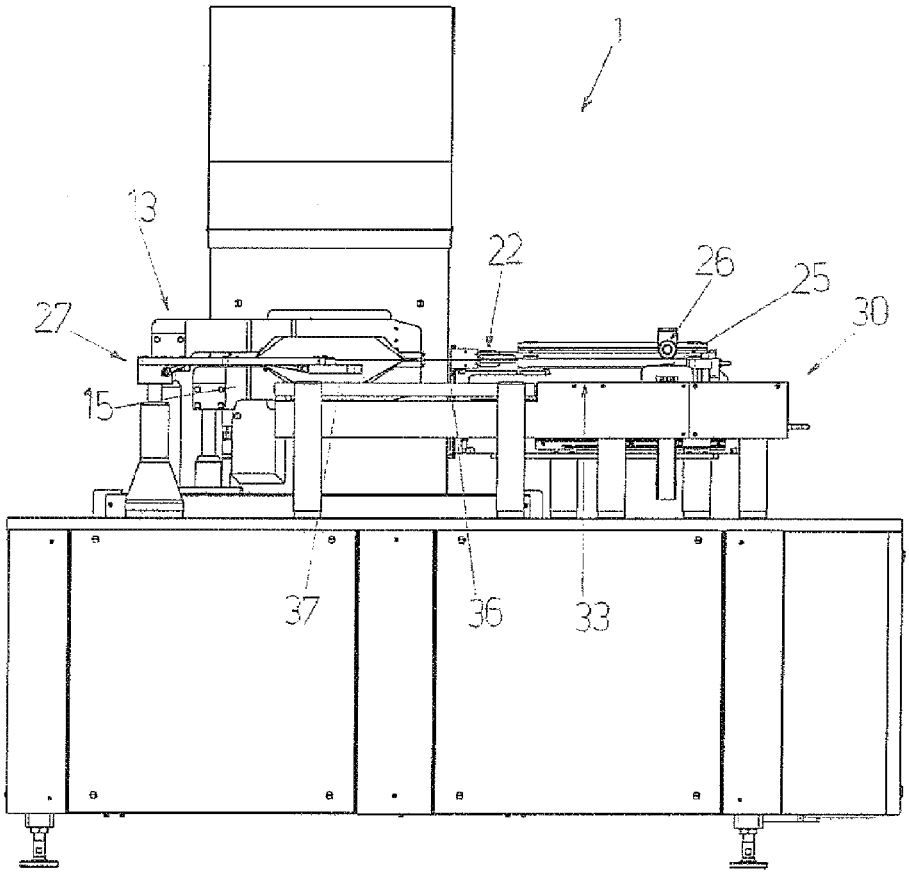
FIGS. 5C, 5D are respectively a front view and a view from above of the apparatus of FIG. 5A.
Figure 5D:
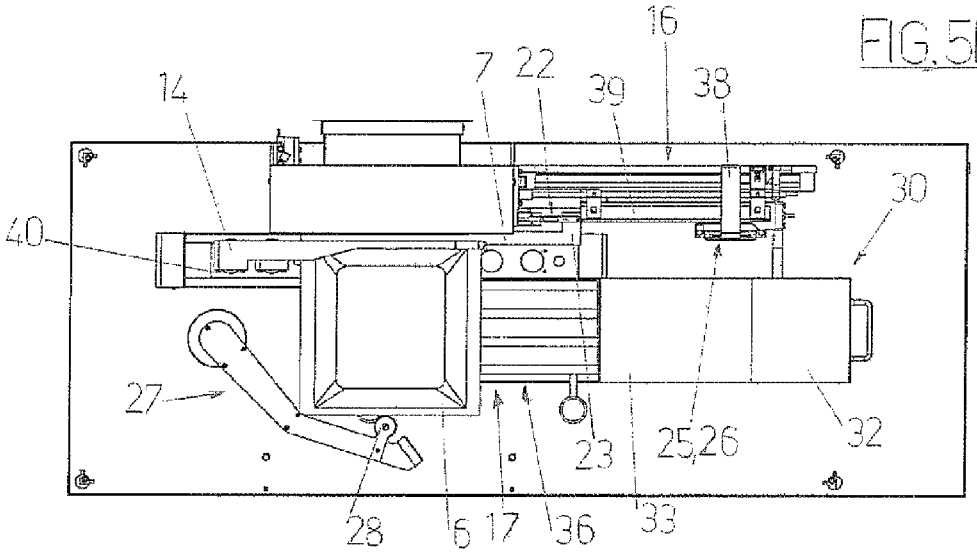

At this point, the lever 39 reaches the disengaged position, freeing the flap 7 of the sterile package 5 (FIG. 5B). The jaws 14, 15 maintain the clamped configuration on the sterile package 5 and are moved towards the second operating station 17; the sterile package 5 is thus moved by the jaws 14, 15 by dragging from the first operating station 16, where it was resting on the raised upper surface 33 of the loading member 30, to the second operating station 17, where it goes to rest on the rest plane 36 up to facing the inlet mouth 43 of the inlet section 42 of the sterile environment (FIGS. 5A, 5C, 5D).

Figure 6A:
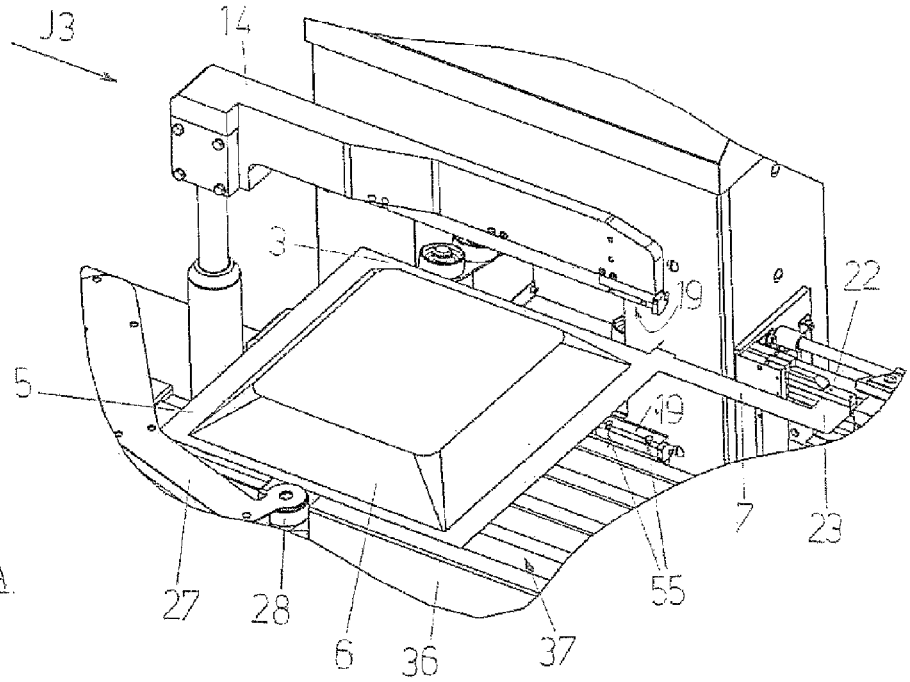
FIG. 6A is a perspective view of a detail in larger scale K5 of FIG. 5A, relating to a sixth operating configuration, in which a detail has not been illustrated in order better to evidence others.
Figure 6B:
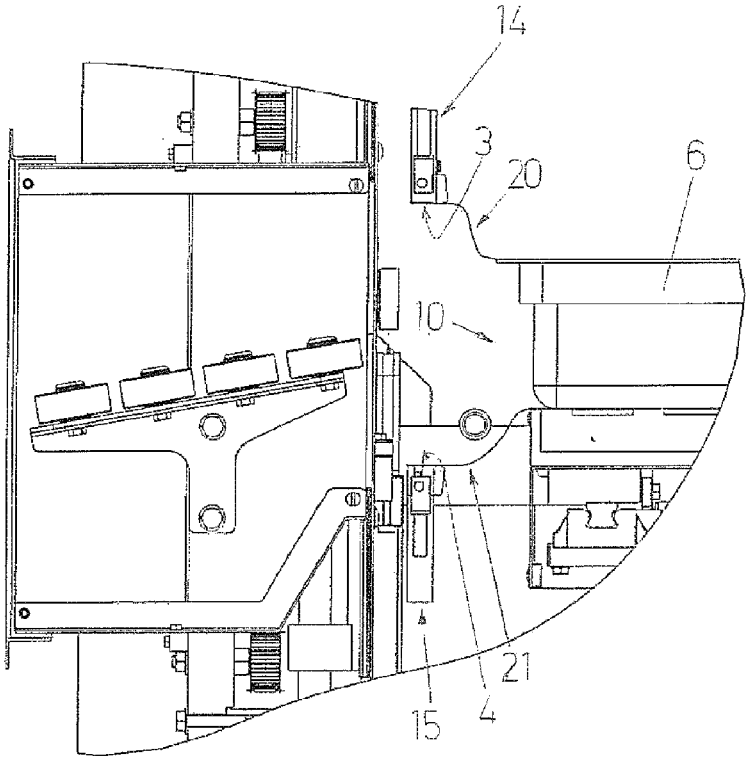
FIG. 6B is a lateral view of detail K5 of FIG. 5A, according to arrow J3 denoted in both FIG. 5A and FIG. 6A and relating to the sixth operating configuration.

Thereafter the first aspirating means 55 associated to the jaws 14, 15 are activated, the jaws 14, 15 are activated such as to reach the relative distanced configuration and the inlet mouth 43 of the inlet section 42 is opened (FIG. 6A). The portions 20, 21 of sterile package 5 opposite and containing the facing first surface 3 and the second surface 4 of the sterile package 5 are thus distanced from one another, making the opening in the sterile package 5 available, as can be seen in particular in FIG. 6B. For reasons of simplicity, in FIG. 6A (but, as will become clear, also in FIG. 7A) the portions 20, 21 of sterile package 5 that are opposite and containing the facing first surface 3 and the second surface 4 of the sterile package 5 have not been illustrated.

Figure 7A:
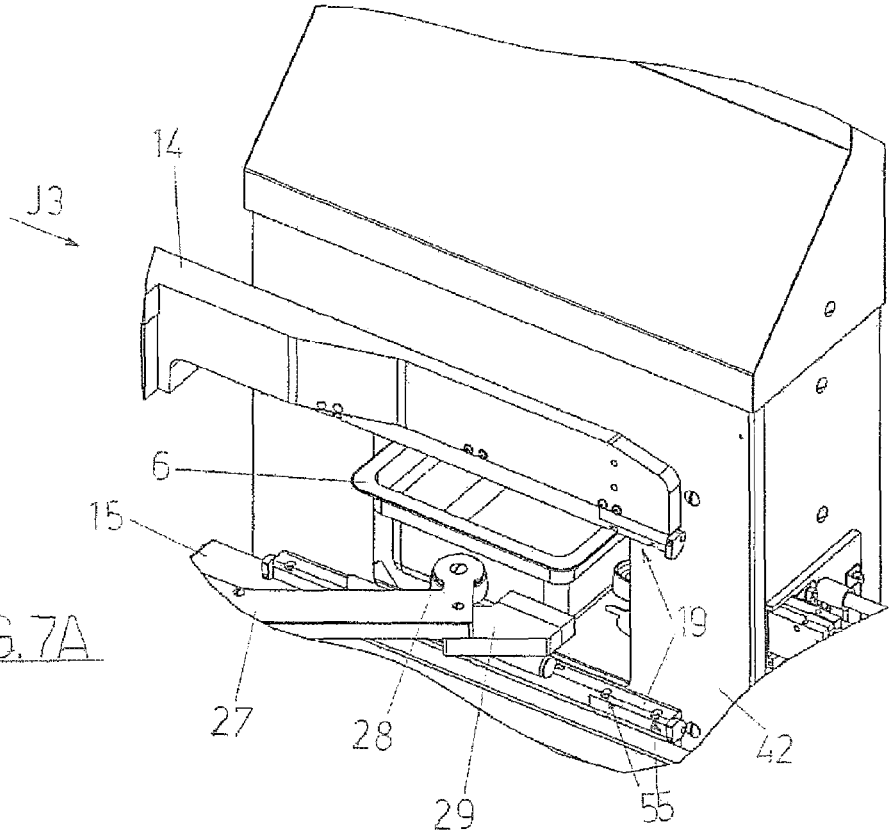
FIG. 7A is a perspective view of detail K5 of FIG. 5A in enlarged scale relating to a seventh operating configuration, in which a detail has not been illustrated in order better to evidence others.
Figure 7B:
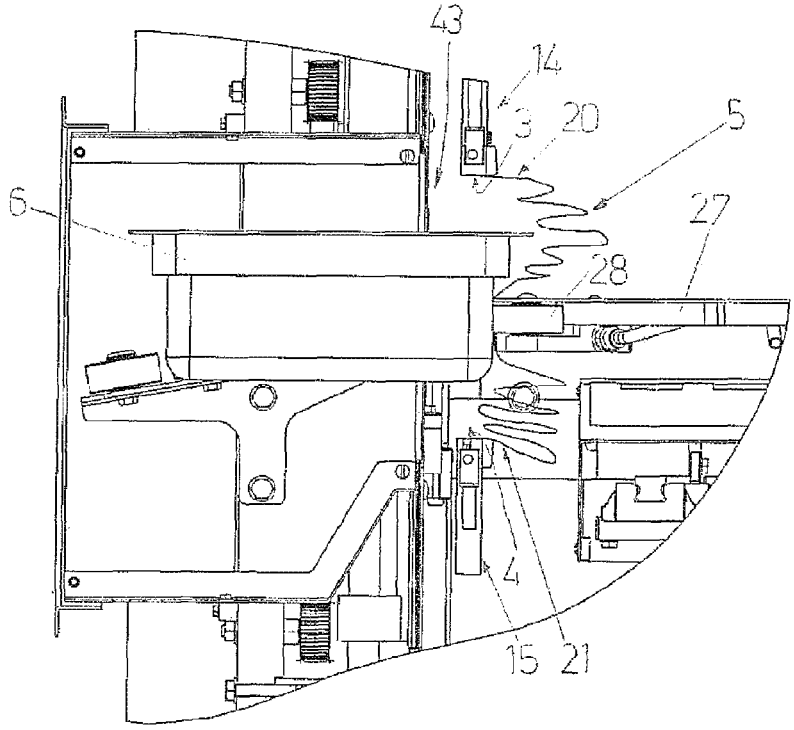
FIG. 7B is a lateral view of detail K5 of FIG. 5A, according to arrow J3 indicated in both FIG. 5A and FIG. 7A and relating to a seventh operating configuration.

Lastly, the rotating arm 27 is activated in rotation to push the sterile package 5, and the sterile product 6 contained, towards the inlet mouth 43 of the inlet section 42, and the second aspirating means 29 are activated to retain the sterile package 5, see FIGS. 7A, 7B. For reasons of simplicity, also in FIG. 7A the portions 20, 21 of sterile package 5 that are opposite and contain the opposite first surface 3 and the second surface 4 of the sterile package 5 are not illustrated. Thus only the sterile product 6 passes through the inlet mouth 42, while the sterile package 5 is retained by the second arm, via the second aspiration means, and by the second pliers 22, again in the gripping configuration of the ends 23 of the flap 7.

In a step that is not illustrated, the second pliers 22 reach the release position and the rotating arm 27 is activated in rotation to bring the sterile package 5 to a zone for collecting the sterile packages, for example a collecting tub or a slide which leads to a collecting tub.

The present invention further relates to a method for removing a sterile product 6 from a sterile pack 5 containing it, of which the above-described apparatus 1 is only one from among the possible application examples.

The method comprises the following steps:

clamping against one another a first and a second facing surfaces which are a part of a sterile package 5, locatable between a sterile product 6 contained in the sterile package 5 and a relative first flap 7 of the sterile package 5;

cutting the sterile package 5 at a region 9 thereof which is interposed between the reciprocally-clamped facing first surface 3 and second surface 4 of the sterile package 5 and the flap 7 of the sterile package 5 such that once the facing first surface 3 and second surface 4 of the sterile package 5 are disengaged by the clamping action, an opening 10 is identified in the sterile package 5, through which the sterile product 6 can be expelled;

disengaging the facing first surface 3 and second surface 4 of the sterile package 5 from the clamping action;

expelling the sterile product 6 from the sterile package 5 by exerting a pushing action on an external surface of the sterile package 5 such as to move the sterile product 6 through the opening 10.

The method can comprise the step of retaining the sterile package 5 during expulsion of the sterile product 6 through the opening 10.

By way of example, the cutting step is done in a first operating station 16; the expulsion step is done at a second operating station 17; and the sterile package 5 is transferred along a movement direction W towards the second operating station 17, maintaining the opposite first surface 3 and the second surface 4 of the sterile package 5 clamped.

The cutting step preferably causes a partial detachment of the flap 7 of the sterile package 5, the flap 7 remaining attached to the sterile package 5 at the end of the flap 7 which is arranged further away with respect to the second operating station 17; the position of the end 23 of the flap 7 which is arranged closer to the second operating station 17 is controlled during the transfer of the sterile package 5 towards the second operating station 17 and during the 5 expulsion of the sterile product 6, such that the flap 7 remains connected to the remaining part of the sterile package 5 and does not obstruct the expulsion step of the sterile product 6.

The step of expelling can be preceded by a step of relative distancing of portions 20, 21 of opposite sterile package 5 containing respectively the facing first surface 3 and the second surface 4 of the sterile package 5 by the jaws 14, 25 that are respectively mobile such as to clamp and disengage the facing first surface 3 and the second surface 4 of the sterile package 5, which jaws 14, 15 bear aspirating means predisposed along the relative opposite contact surfaces.

The pushing action on the external surface of the sterile package 5 can be exerted on a portion of sterile package 5 which is arranged on the opposite side to the opening 10 with respect to the position of the sterile product 6 contained in the sterile package 5.

It is understood that the above has been described by way of non-limiting example, and any eventual constructional variants are taken to fall within the ambit of protection of the present technical solution, as claimed herein below.

The invention claimed is:

1. An apparatus for removing a sterile product from a closed sterile package containing the sterile product, comprising:

a clamp for clamping against one another a facing first surface and a second surface which are part of the sterile package, the facing first surface and second surface being clamped in a region locatable between the sterile product contained in the sterile package and a relative flap of the sterile package, to form a closed sterile environment around the sterile product within the sterile package and a segregated region between the clamped first and second facing surfaces and the flap;

a cutter for cutting the sterile package in the region interposed between the facing first surface and second surface, clamped to one another, of the sterile package and the flap, so as to maintain a sterile environment around the sterile product during cutting, the cutter forming an opening in the sterile package through which the sterile product can be expelled;

a pusher for expelling the sterile product completely from the sterile package by exerting a pushing action on an external surface of the sterile package such as to move the sterile product through the opening after a release of the clamp and a disengagement of the facing first surface and second surface of the sterile package, the sterile product expelled without the sterile product being contacted by the apparatus for removing the sterile product.

2. The apparatus of claim 1, further comprising retaining means for retaining the sterile package during expulsion of the sterile product through the opening.

3. The apparatus of claim 1, wherein the clamp comprises a first pliers having two jaws, reciprocally movable in nearing and distancing respectively in order to clamp and disengage the facing first surface and second surface of the sterile package.

4. The apparatus of claim 3, further comprising a first work station in which the cutter cuts the sterile package, and a second work station adjacent to the first work station, in which the pusher operates to expel the sterile product through the opening of the sterile package, the jaws being movable between the first work station and the second work station.

5. The apparatus of claim 3, wherein retaining means are provided for retaining the sterile package during expulsion of the sterile product through the opening, the retaining means being aspirators acting along facing contact surfaces of the jaws in order to enable distancing of opposite portions of sterile package containing respectively the facing first surface and second surface of the sterile package.

6. The apparatus of claim 4, further comprising a second pliers arranged in the first work station for gripping an end of the flap closer to the second work station, dimensions of the sterile package and a position of the second work station with respect to the first work station being such that the flap, once partially detached by the cutting of the sterile package, can be retained by the second pliers when the sterile package is transferred into the second work station and during expulsion of the sterile product, remaining connected to a remaining part of the sterile package and without obstructing the expulsion of the sterile product.

7. The apparatus of claim 1, further comprising removable blocking means for the flap for facilitating cutting of the sterile package, and wherein the cutter has a counter-blade, a first rotating cutting roller provided with a cutting edge, which first cutting roller faces the counter-blade, means for pressing the first rotating cutting roller against the counter-blade during the cutting of the sterile package.

8. The apparatus of the claim 7, wherein the counter-blade and the first cutting roller are idle rollers.

9. The apparatus of claim 1, wherein the pusher has a rotating arm which rotates with respect to a vertical axis, provided with a terminal part for abutting against the sterile package and an aspirator activated to retain the sterile package once the sterile product has been expelled through the opening;

the rotating arm being arranged so as to exert a pushing action on a portion of the sterile package which is arranged on an opposite side of the opening with respect to a position of the sterile product contained in the sterile package.

* * * * *